United States Patent [19]

Wenzel

[11] Patent Number: 4,699,053

[45] Date of Patent: Oct. 13, 1987

[54] DEVICE FOR SELECTIVELY CONTROLLING THE OPERATION OF INKING OR DAMPING UNIT ROLLERS OF A PRINTING PRESS

[75] Inventor: Jürgen Wenzel, Hainburg, Fed. Rep. of Germany

[73] Assignee: M.A.N.-Roland Druckmaschinen Aktiengesellschaft, Fed. Rep. of Germany

[21] Appl. No.: 838,293

[22] Filed: Mar. 10, 1986

[30] Foreign Application Priority Data

Mar. 12, 1985 [DE] Fed. Rep. of Germany ..... 3508661

[51] Int. Cl.[4] ..... B41L 25/00

[52] U.S. Cl. ..... 101/148; 74/479; 74/524; 74/548; 74/625; 101/141; 101/145; 101/352; 403/93; 403/328

[58] Field of Search ..... 101/130, 140, 141, 142, 101/144, 145, 137, 148, 352, 351; 74/471 R, 479, 524, 548, 625; 403/328, 93; 180/287

[56] References Cited

U.S. PATENT DOCUMENTS

| | | | |
|---|---|---|---|
| 3,412,676 | 11/1968 | Tunkin et al. | 101/144 |
| 3,457,857 | 7/1969 | Burger | 101/144 |
| 4,203,291 | 5/1980 | Youngers | 74/471 R X |
| 4,479,402 | 10/1984 | Reichel et al. | 74/625 |
| 4,484,492 | 11/1984 | Cadic | 74/625 |
| 4,519,487 | 5/1985 | Florin | 74/675 X |
| 4,538,513 | 9/1985 | Sedlák et al. | 101/144 X |

FOREIGN PATENT DOCUMENTS

| | | | |
|---|---|---|---|
| 2809166 | 9/1979 | Fed. Rep. of Germany | 74/625 |
| 121338 | 7/1983 | Japan | 74/625 |

*Primary Examiner*—Edgar S. Burr
*Assistant Examiner*—Moshe I. Cohen
*Attorney, Agent, or Firm*—Leydig, Voit & Mayer

[57] ABSTRACT

A device for selectively controlling the manual or automatic operation of inking or damping rollers of a printing press wherein the torque which produces the adjusting movement is transmissible through a non-positive coupling and a spring-biased manually releasable and automatically engaging connecting element, characterized in that a first start-stop lever is connected to an input coupling member for the automatic starting and stopping of printing, an operating lever is connected to a handle for manual control of the starting and stopping of printing and a second start-stop lever is connected to an output coupling member and is operative to engage and disengage the rollers. The first and second start-stop levers and the manual control lever are mounted concentrically about one another on a cylindrical dowel secured to the press frame, first coupling means including a spring-biased, radially movable locking pin for normally coupling the first and second start-stop levers together, second coupling means including a peg connected to the handle and being radially movable in the operating lever for biasing the locking pin out of coupling engagement with the second start-stop lever and for simultaneously coupling the operating lever and the second start-stop lever together for manually controlled movement of the output member independent of movement of the first start-stop lever and the input member.

4 Claims, 2 Drawing Figures

DEVICE FOR SELECTIVELY CONTROLLING THE OPERATION OF INKING OR DAMPING UNIT ROLLERS OF A PRINTING PRESS

FIELD OF THE INVENTION

The present invention relates generally to a device for controlling the operation of inking and/or damping rollers of printing presses, and more particularly concerns such a device which is selectable for operation in two modes either automatically, by way of the printing control, or manually.

BACKGROUND OF THE INVENTION

Various devices are known in the art for controlling either manually or automatically the operation of the inking and/or damping rollers in printing presses. Generally, however, these prior art devices suffer from the disadvantage that the coupling provided for both modes of operation is by the same connecting element. To this end, a spring biased wedge or tongue must be manually released, usually by being moved axially with wastage of space, out of a groove in a start-stop lever for automatic operation so that the rolls may be brought into and out of operation by means of a control lever irrespective of how printing is being controlled. Upon release, the previously disengaged wedge is automatically re-engaged by the spring. However, since the wedge always remains rigidly secured to the control lever, unwanted torque is transmitted to the control lever for manual operation when the press is set to automatic control of the rollers. This represents a constant risk of danger to the press operator since the unexpected control lever movement may sprain the operator's hand and arm if the control for automatic roller operation is accidentally actuated simultaneously.

OBJECTS AND SUMMARY OF THE INVENTION

It is therefore the primary aim of the invention to provide a selectable facility of the kind hereinbefore set out to enable a changeover to be made between the manual and automatic modes of operation by means of a compact non-positive coupling without the control lever for manual operation being able to transmit a torque in the automatic mode.

In accordance with the present invention, a device for selectively controlling the manual or automatic operation of inking or damping rollers of a printing press is provided, wherein the torque which produces the adjusting movement is transmissible through a non-positive coupling and a spring-biased manually releasable and automatically engaging connecting element. A first start-stop lever is connected to an input coupling member for the automatic starting and stopping of printing, an operating lever is connected to a handle for manual control of the starting and stopping of printing and a second start-stop lever is connected to an output coupling member and is operative to engage and disengage the rollers. The first and second start-stop levers and the manual control lever are mounted concentrically about one another with first coupling means including a spring-biased, radially movable locking pin normally coupling the first and second start-stop levers together, and second coupling means including a peg connected to the handle for biasing the locking pin out of coupling engagement with the second start-stop lever and for simultaneously coupling the operating lever and the second start-stop lever together for manually controlled movement of the output member independent of movement of the first start-stop lever and the input member.

These and other features and advantages of the invention will be more readily apparent upon reading the following description of the preferred embodiments of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 2:
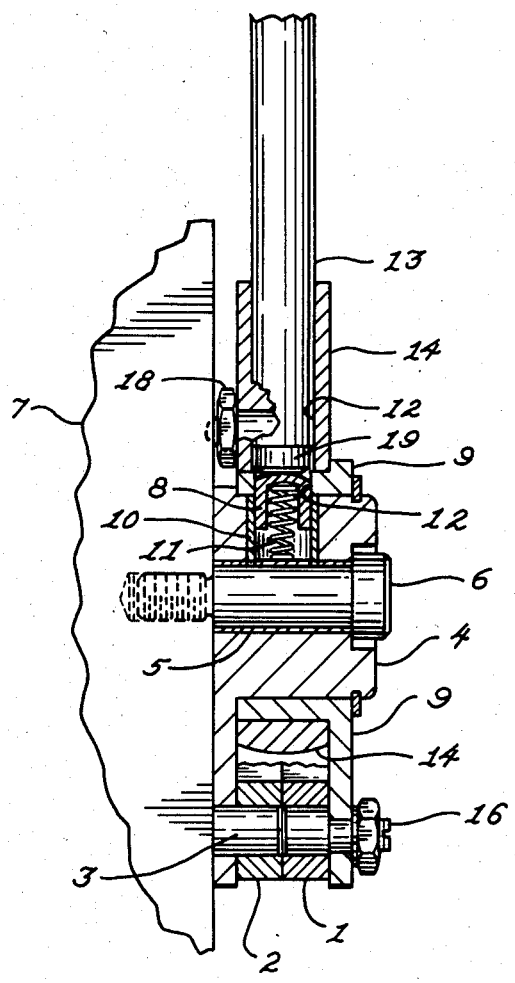
Figure 1:
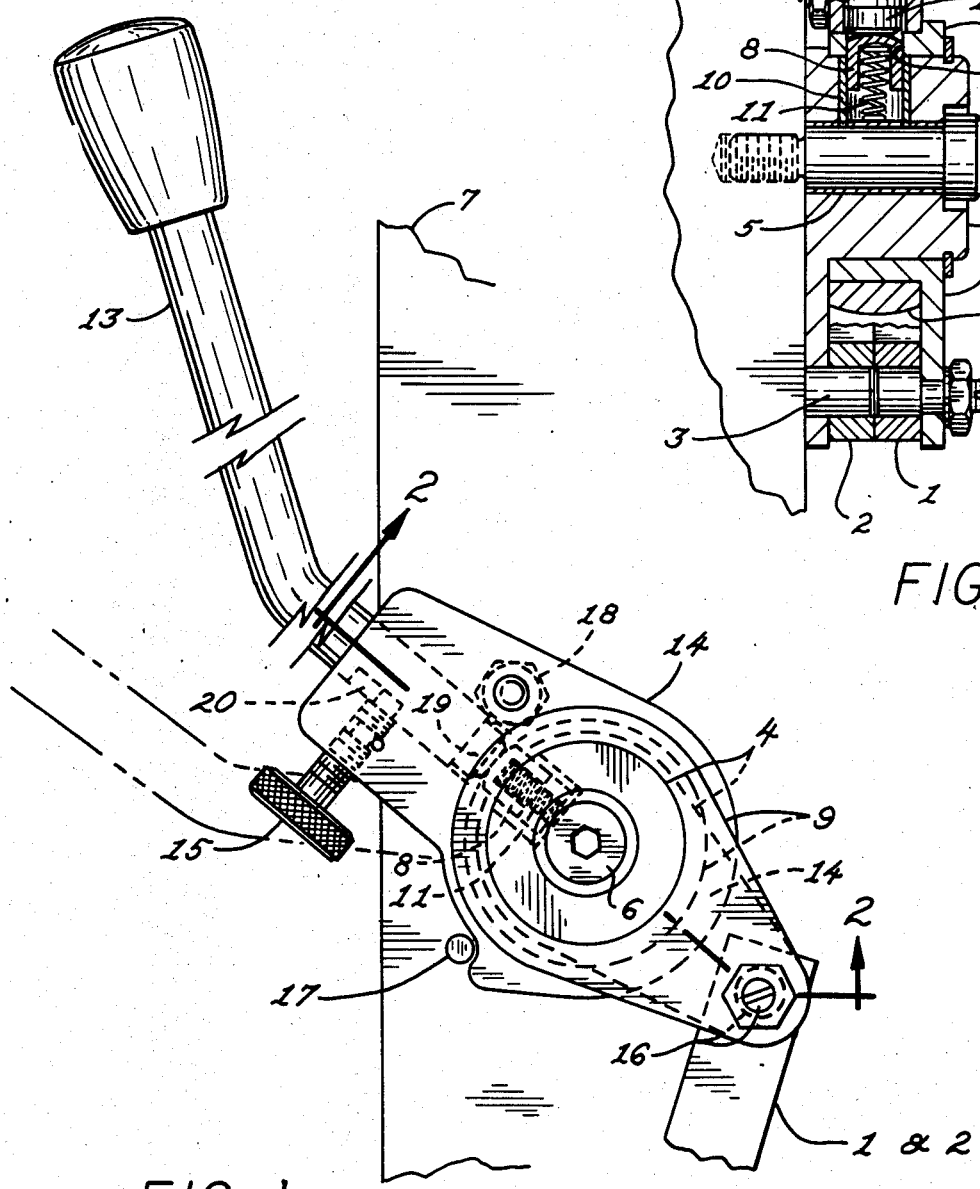
FIG. 1 is a partial side elevational view of a selectable device for bringing the inking and/or damping rollers into and out of operation according to the present invention; and, FIG. 2 is a section through the device shown in FIG. 1, taken substantially along line 2—2.

Turning now to the drawings there is shown in FIG. 1, a portion of a printing press having a frame 7 on which the selective control device of the present invention is mounted. For movement into and out of engagement with the printing form roller of the press, the inking rollers are pivoted in known manner, for example, by means of an output coupling member 1. The inking rollers are connected to the printing control and move into and out of operation automatically with the printing. To this end, an input coupling member 2 mounted on a pin 3 in a first start-stop lever 4 is adapted to pivot in response to the start and stoppage of printing. The lever 4 is mounted on a bushing 5 disposed on a cylindrical dowel 6 secured to the press frame 7.

In accordance with the invention, a locking pin 8 provides a positive connection with a second start-stop lever 9 disposed concentrically like a ring above the first such lever 4. The pin 8 is slidably mounted in a bushing 10 secured radially in the lever 4 and the pressure of a spring 11 maintains the pin 8 in engagement with a radial slideway 12 for a peg 19 carried by the end of a control handle 13. The peg 19 normally bears on the pin 8.

The handle 13 with the peg 19 is preferably mounted for radial movement in a control lever 14 which is disposed concentrically like a ring about the second start-stop lever 9. The amount of radial travel of the handle 13 is accurately limited by means of a knurled screw 15 projecting into a limiting groove 20 in the handle 13. The spring 11 always acts on the handle 13 in the release position so that, by way of the lever 4, pin 8, lever 9 and the coupling member 1, which is mounted on an eccentric pin 16, a torque can be transmitted in a compact arrangement for automatic disengagement of the rollers without the handle 13 moving. A cylindrical pin 17 and a resilient pressure detent member 18 locate the handle 13 and prevent simultaneously the rotation of the lever 14. Also, when the roller control is on the automatic mode, there is never any risk of the operator's hand and arm being sprained or squeezed.

When the handle 13 is pressed in so that the pin 8 moves out of the lever 9 in accordance with the stroke or radial movement, so that the connection releases, the rollers can be moved into and out of engagement with the form roller manually. To this end, the peg 19 provides a non-positive connection with the second start-stop lever 9. Upon release of the handle 13 the peg 19 with the handle 13 and the pin 8 automatically return to their original position so that the automatic mode of roller operation is resumed automatically.

I claim as my invention:

1. A device for selectively controlling the operation of inking or damping rollers of a printing press having a frame, the device being selectable for operation in two modes, either automatically by way of the printing control, or manually, the torque which produces the adjusting movement being transmissible through a non-positive coupling and a spring-biased manually releasable and automatically engaging connecting element, characterized in that a first start-stop lever is connected to an input coupling member for the automatic starting and stopping of printing, an operating lever is connected to a handle for manual control of the starting and stopping of printing and a second start-stop lever is connected to an output coupling member and is operative to engage and disengage the rollers, said first and second start-stop levers and said manual control lever being mounted concentrically about one another on a cylindrical dowel secured to the press frame, first coupling means including a spring-biased, radially movable locking pin for normally coupling said first and second start-stop levers together, second coupling means including a peg connected to said handle and being radially movable in said operating lever for biasing said locking pin out of coupling engagement with said second start-stop lever and for simultaneously coupling said operating lever and said second start-stop lever together for manually controlled movement of said output member independent of movement of said first start-stop lever and said input member.

2. A selective control device as defined in claim 1 including spring-biased detent means interposed between said operating lever and said press frame for releasably holding said operating lever in print starting position.

3. A selective control device as defined in claim 1 wherein said output coupling member is adjustably mounted on an eccentric pin carried by said second start-stop lever.

4. A selective control device as defined in claim 1 including means for limiting the radial movement of said handle and peg relative to said operating lever.

* * * * *